US008544680B2

(12) United States Patent
Akana et al.

(10) Patent No.: US 8,544,680 B2
(45) Date of Patent: Oct. 1, 2013

(54) PACKAGING ASSEMBLY

(75) Inventors: Jody Akana, San Francisco, CA (US); Bartley K. Andre, Menlo Park, CA (US); Jeremy Bataillou, San Francisco, CA (US); Daniel J. Coster, San Francisco, CA (US); Daniele De Iuliis, San Francisco, CA (US); Evans Hankey, San Francisco, CA (US); Julian Hoenig, San Francisco, CA (US); Richard P. Howarth, San Francisco, CA (US); Jonathan P. Ive, San Francisco, CA (US); Duncan Robert Kerr, San Francisco, CA (US); Shin Nishibori, Kailua, HI (US); Matthew Dean Rohrbach, San Francisco, CA (US); Peter Russell-Clarke, San Francisco, CA (US); Christopher J. Stringer, Woodside, CA (US); Eugene Antony Whang, San Francisco, CA (US); Rico Zorkendorfer, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/416,855

(22) Filed: Mar. 9, 2012

(65) Prior Publication Data

US 2012/0228320 A1 Sep. 13, 2012

Related U.S. Application Data

(60) Provisional application No. 61/452,053, filed on Mar. 11, 2011.

(51) Int. Cl.
*B65D 43/22* (2006.01)
*B65D 17/34* (2006.01)

(52) U.S. Cl.
USPC ..... 220/833; 220/359.2

(58) Field of Classification Search
USPC ..... 220/833, 810, 359.2, 359.1, 4.01; 229/209, 206, 246, 136, 133, 126, 124; 493/151, 150; 206/576, 474, 472, 721, 701; 53/491, 484
IPC ..... B65D 5/66, 5/64, 5/34, 17/34, 43/22
See application file for complete search history.

(56) References Cited

U.S. PATENT DOCUMENTS

| | | | | |
|---|---|---|---|---|
| 306,406 | A * | 10/1884 | Lane | 229/120 |
| 1,990,637 | A * | 2/1935 | Daller | 493/114 |
| 2,713,452 | A * | 7/1955 | Williamson | 229/117.08 |
| 2008/0197178 | A1 * | 8/2008 | Aldridge et al. | 229/120.08 |

FOREIGN PATENT DOCUMENTS

JP 2006240683 A * 9/2006

* cited by examiner

*Primary Examiner* — Robert J Hicks
(74) *Attorney, Agent, or Firm* — Sterne, Kessler, Goldstein & Fox P.L.L.C.

(57) ABSTRACT

A packaging system is configured to package a product to form a packaged product assembly. The packaging system includes a lid including a major panel, side panels, and a tab extending from one of the side panels. The packaging system also includes a box hingedly coupled to the lid that includes side walls and a bottom wall with a slot defined therein. The product may be retained by the lid against the major panel by first and second end flaps. As the lid and box are folded toward one another, the product may be loaded into the box and the tab and an adhesive member coupled thereto may extend through the slot in the bottom wall of the box. The adhesive member may then be adhered to a back surface of the box to retain the product in the packaging system. Related methods are also provided.

15 Claims, 11 Drawing Sheets

PACKAGING ASSEMBLY

This application claims priority to and the benefit under 35 U.S.C. §119(e) of U.S. Provisional Application Ser. No. 61/452,053, filed Mar. 11, 2011, entitled PACKAGING ASSEMBLY PROCEDURE by Akana et al, the entire disclosure of which is hereby incorporated herein by reference.

TECHNICAL FIELD

The present disclosure relates generally to packaging for products, and more particularly to methods, systems, and assemblies for packaging products.

BACKGROUND

Competition in the consumer products markets has led manufacturers to improve the appeal not only of the products they sell, but also the retail packaging therefore. In this regard, appealing retail packaging may encourage purchase of products that a consumer may otherwise overlook. Accordingly, design considerations for packaging have become increasingly more important.

In addition to having aesthetic appeal, packaging should be easy to use in terms of insertion of products therein. Further, packaging should ideally be easy to open. While many designs and techniques used to package products have generally worked well in the past, there is always a desire to improve packaging, such that improved functionality and/or appearance is provided.

SUMMARY

The present disclosure provides a packaging system configured to package a product therein to form a packaged product assembly, and related methods. The packaging system may include a lid with a tab and a box with a slot hingedly connected thereto. An adhesive member may be coupled to the tab. An intermediate sheet may be coupled to the product, then the product and the intermediate sheet may be positioned between end flaps of the lid such that the lid retains the product in place. Thereafter, the lid and the box may be pivoted relative to one another such that the lid moves to a closed configuration that closes the upper opening of an interior compartment defined by the box.

Since the lid holds the product, the product may be loaded into the box substantially simultaneously with pivoting the lid relative to the box. Further, since the tab extends from the lid, the tab and the adhesive member may be inserted through the slot defined in the bottom wall of the box substantially simultaneously with pivoting the lid relative to the box and loading the product into the box. After the tab and the adhesive member are inserted through the slot in the bottom wall of the box, the adhesive member may be folded over and adhered to the back surface of the bottom wall of the box. Accordingly, the product may be retained between the lid and the box. The product may thereafter be retrieved from the packaging system by detaching the adhesive member from the box and pushing the adhesive member and the tab back out of the slot while pivoting the lid and the box to an open configuration. Accordingly, scissors or other tools may not be required to open the package.

Other apparatuses, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed packaging systems, packed product assemblies, and methods for packaging a product. These drawings in no way limit any changes in form and detail that may be made to the disclosure by one skilled in the art without departing from the spirit and scope of the disclosure.

DETAILED DESCRIPTION

Exemplary applications of apparatuses, assemblies, systems, and methods according to the present disclosure are described in this section. These examples are being provided solely to add context and aid in the understanding of the disclosure. It will thus be apparent to one skilled in the art that the present disclosure may be practiced without some or all of these specific details. In other instances, well known process steps have not been described in detail in order to avoid unnecessarily obscuring the present disclosure. Other applications are possible, such that the following examples should not be taken as limiting.

Improved packaging that simplifies the process for packaging a product is desirable in that it may require less labor to package the product. Thus, the total cost associated with preparing a product for sale may be reduced. Improved aesthetic appeal for packaging also remains desirable, particularly when the packaging is employed for retail sale of a product. Further, packaging that simplifies the process for accessing the product may also be desirable to consumers.

Figure 1:
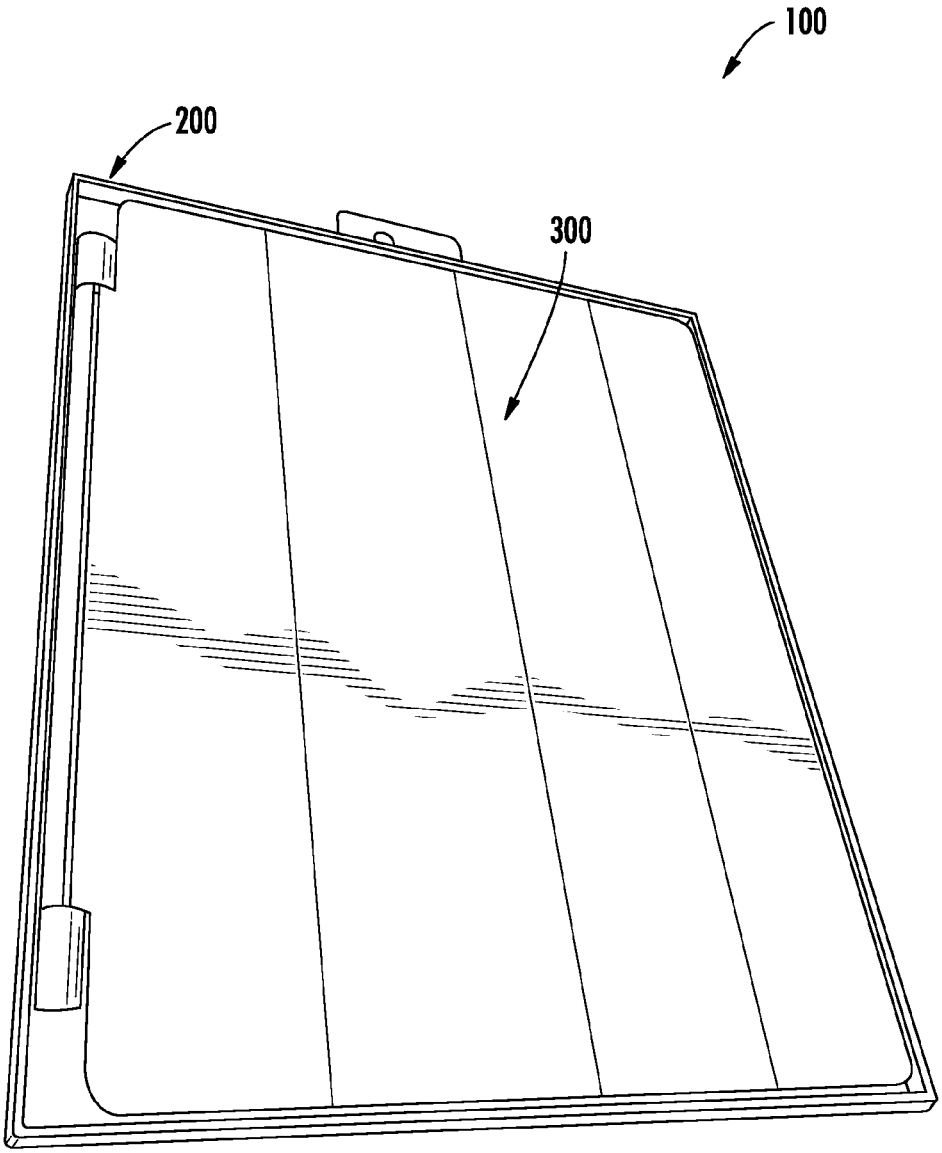
FIG. 1 illustrates a front perspective view of a packaged product assembly comprising a packaging system and a product according to one embodiment of the present disclosure.

In this regard, FIG. 1 illustrates an embodiment of a packaged product assembly 100 according to the present disclosure. As illustrated, the packaged product assembly 100 includes a packaging system 200 and a product 300 stored therein. In the illustrated embodiment, the product 300 comprises a SMART COVER, as sold by APPLE, Inc. of Cupertino, Calif. However, the packaging system 200 may be employed to package various other products in other embodiments. For example, the dimensions and/or shape of the packaging system 200 may be adapted to conform to the size and/or shape of the product 300.

Figure 2:
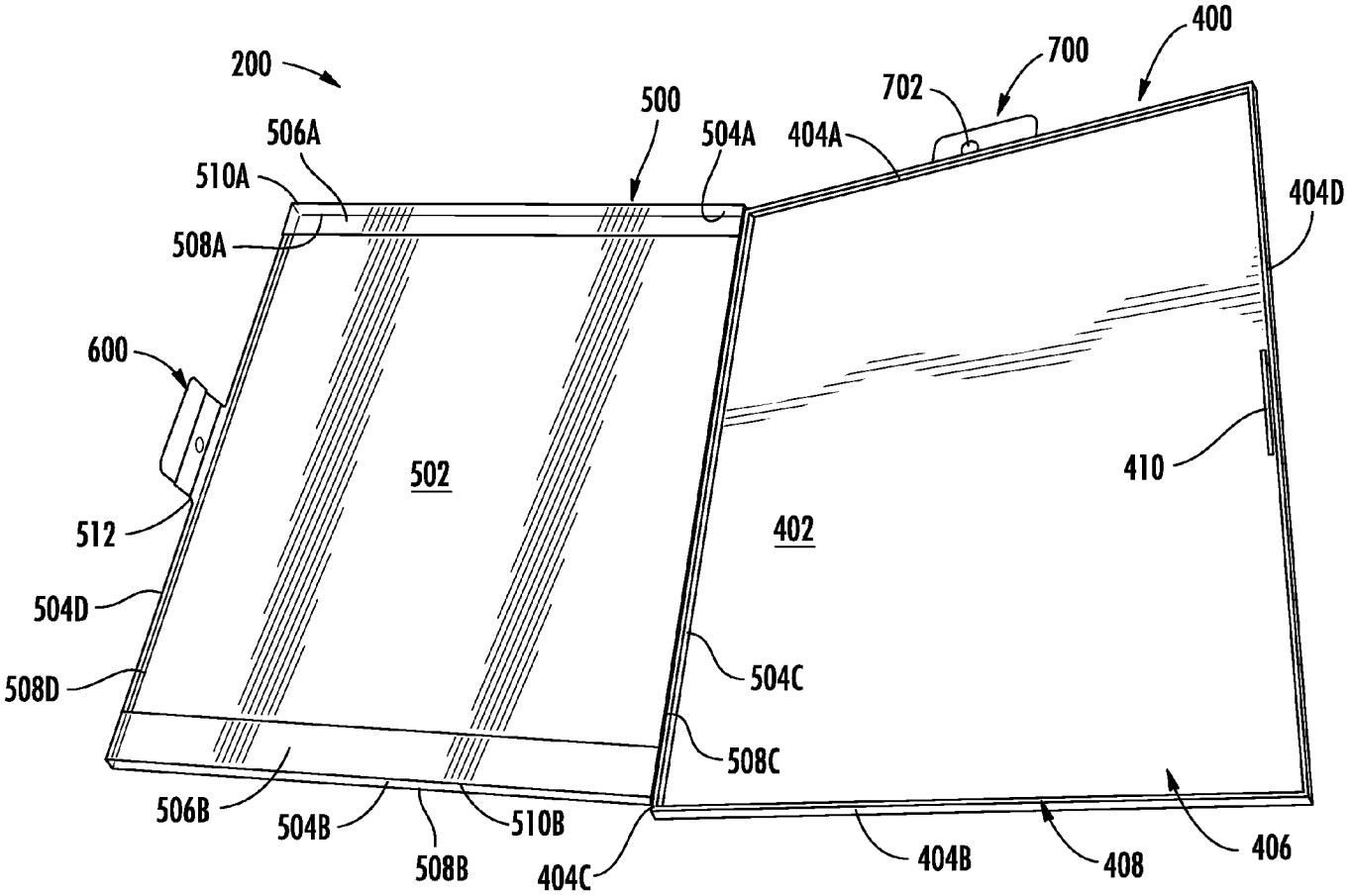
FIG. 2 illustrates the packaging system 200 of FIG. 1 in an open configuration without a product therein.

FIG. 2 illustrates the packaging system 200 in an open configuration without a product therein. As illustrated, in some embodiments the packaging system 200 may include a box 400, a lid 500, and an adhesive member 600. Further, the packaging system 200 may include a hanger tag 700 with an aperture 702 there through. The hanger tag 700 may be configured to receive a hanger through the aperture 702 such that after a product is received in the packaging system 200, the packaged product assembly 100 may be hung for display at a retail location.

The lid 500 may be hingedly coupled to the box 400. In some embodiments the lid 500 and the box 400 may be integrally formed and/or formed from the same material. However, in other embodiments the lid 500 and the box 400 may be separate components formed from different materials. In one example embodiment the box 400 may comprise one or more layers of cardboard, paperboard, paper, and/or other materials that are folded, glued, and/or otherwise formed into a bottom wall 402 and a plurality of sidewalls 404A-D (collectively, "404"). The sidewalls 404 and the bottom wall 402 may define an interior compartment 406 that is configured to receive a product. The sidewalls 404 may define an upper opening 408 to the interior compartment 406 opposite the bottom wall 402. Further, a slot 410 may be defined in the bottom wall 402.

The lid 500 may comprise a plastic material such as polyethylene terephthalate (PET). Embodiments of plastic materials that are translucent or transparent may be advantageously employed to form all or a part of the lid 500 in embodiments of the packaging system 200 employed for retail sales, since consumers may thereby be able to view a product there through. The lid 500 may comprise a major panel 502 and a plurality of side panels 504A-D (collectively, "504"). In order to hingedly couple the lid 500 to the box 400, one of the side panels 504D of the lid may be coupled to one of the sidewalls 404D of the box. Accordingly, the lid 500 may pivot between an open configuration (see, e.g., FIG. 2) in which the upper opening 408 of the box 400 is open and a closed configuration (see, e.g., FIG. 1) in which the lid covers the upper opening.

Figure 3:
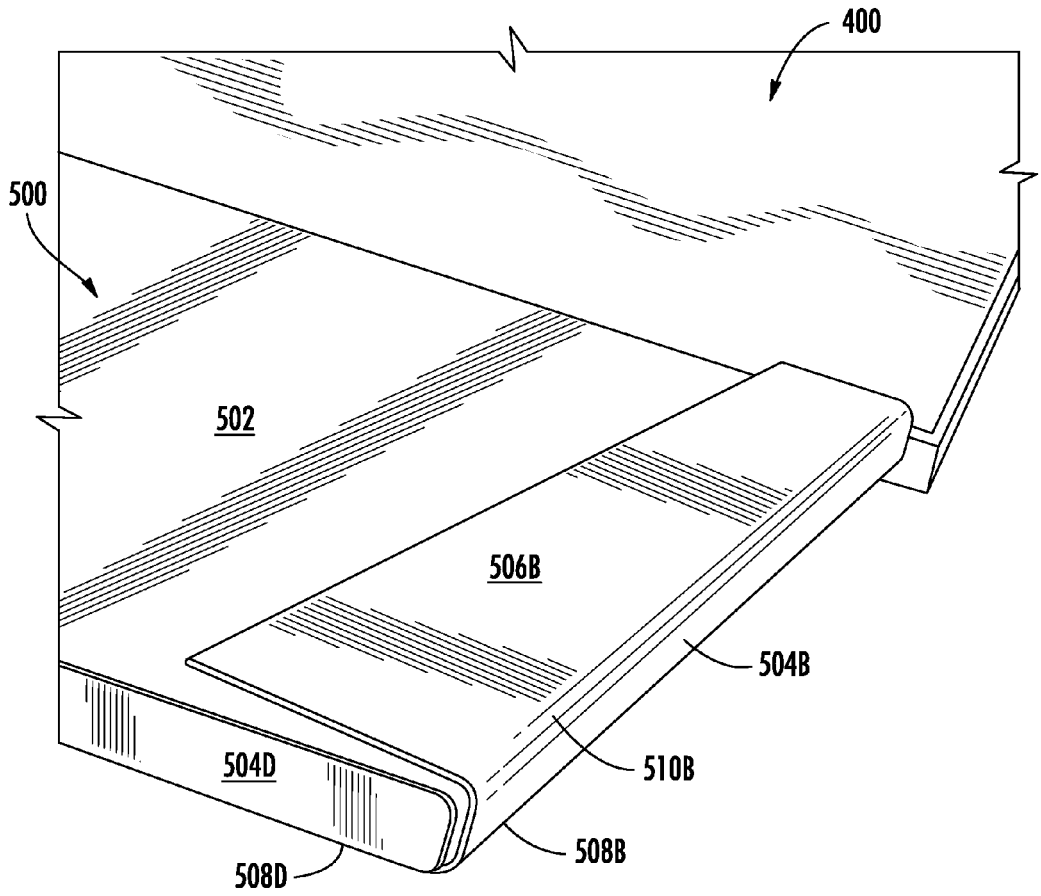
FIG. 3 illustrates an enlarged view of a portion of the lid of the packaging system of FIG. 2.

The lid 500 may further comprise first and second end flaps 506A, B (collectively, "506"). As illustrated, the lid 500 may also include score lines 508A-D (collectively, "508") between the major panel 502 and the side panels 504. The score lines 508 may facilitate folding of the side panels 504 relative to the major panel 502 such that they may be configured at angles relative thereto. For example, FIG. 3 illustrates an enlarged view of a portion of the lid 500 in which the side panels 504 are configured substantially at ninety degrees relative to the major panel 502. Score lines 510A, B (collectively, "510") may also be provided between the end flaps 506 and the side panels 504 to which they connect. In this regard, the score lines 510 may allow the end panels 506 to be folded such that they are substantially parallel to the major panel 502.

Returning to FIG. 2, the lid 500 may additionally include a tab 512. The tab 512 may extend from one of the side panels 504D that is opposite to the one of the side panels 504C hingedly coupled to one of the sidewalls 404C of the box 400. Accordingly, the tab 512 may align with the slot 410 in the bottom wall 402 of the box 400 when the lid 500 is folded to the closed configuration.

Figure 4:
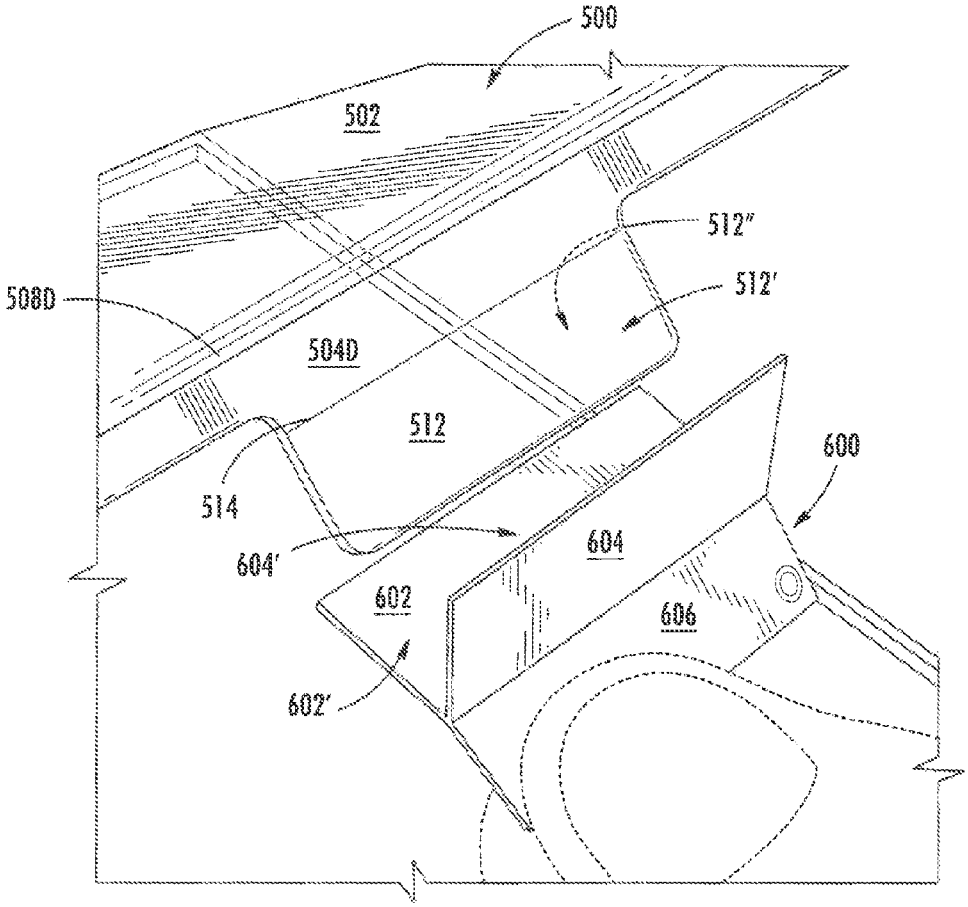
FIG. 4 illustrates an enlarged view of an adhesive member and a tab of the lid of the packaging system of FIG. 2 prior to coupling therebetween.
Figure 5:
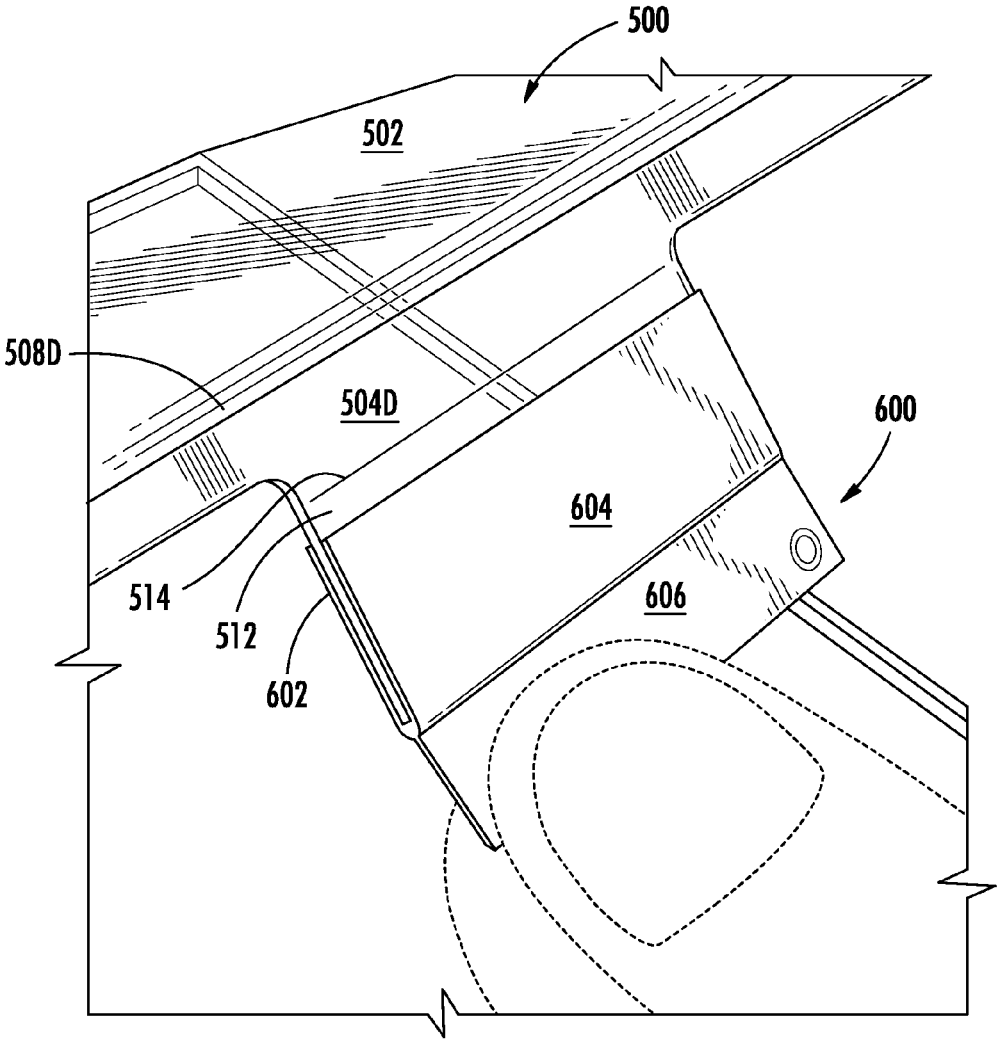
FIG. 5 illustrates the adhesive member and tab of FIG. 4 after coupling therebetween.

The above-mentioned adhesive member 600 may be coupled to the tab 512. In particular, as illustrated in FIG. 4, the adhesive member 600 may comprise a first flap 602, a second flap 604, and an extension 606. The first flap 602 and the second flap 604 may include an adhesive on inner surfaces 602', 604' thereof such that the flaps may couple to first 512' and second 512" opposing surfaces of the tab 512. Thus, as illustrated in FIG. 5, the first and second flaps 602, 604 of the adhesive member 600 may be coupled to the tab 512 and the extension 606 may extend there from.

Note that "adhesive," as used herein, refers to any embodiment of a material that provides for coupling between two members. For example, an adhesive may include glue. However, adhesive coupling between members may also occur via ultrasonic welding, thermal coupling, etc. In this regard, the term "adhesive," and related terms used herein, are not intended to be limited to use of glues, but rather refer to any embodiment of a bonding agent or method for bonding.

Figure 6:
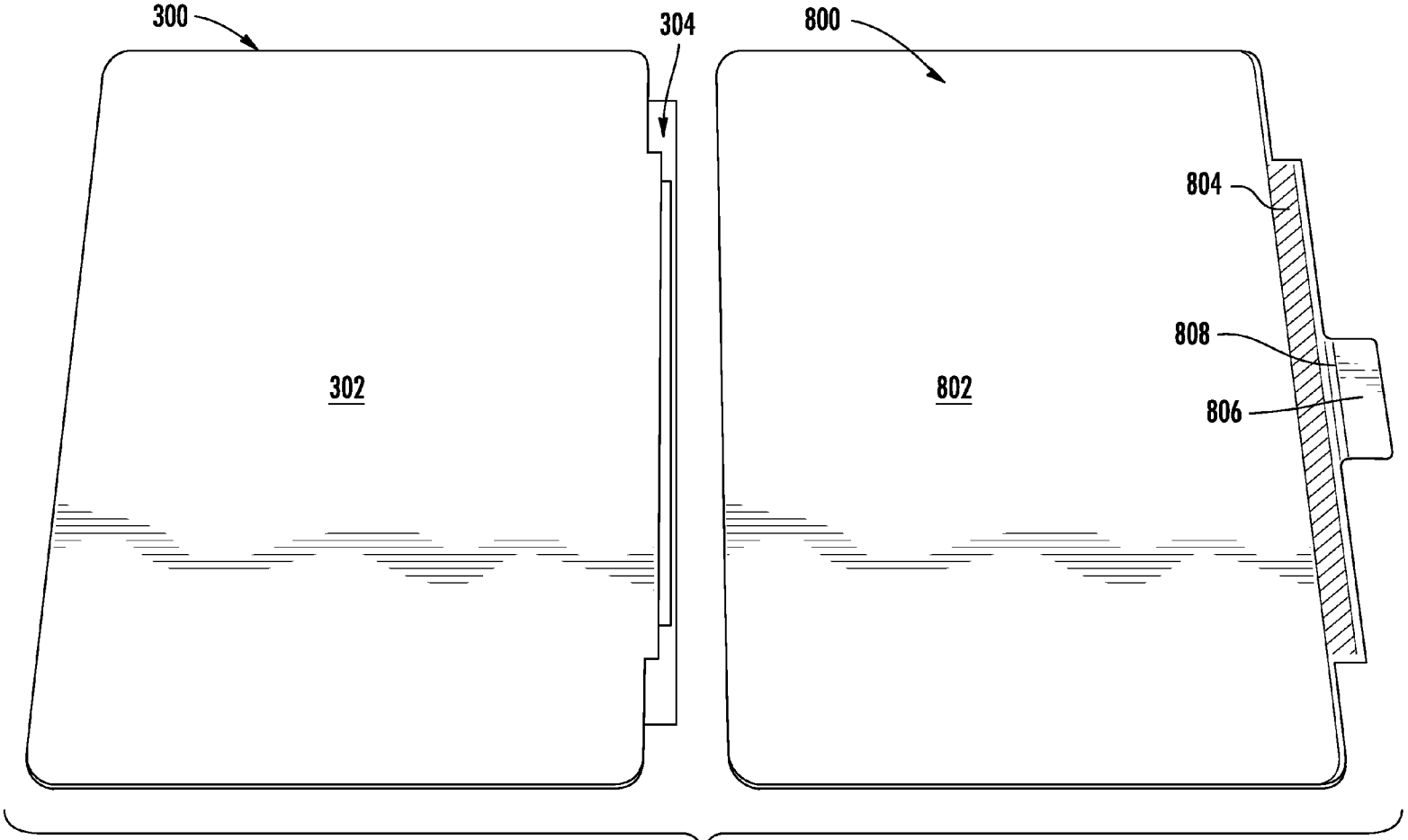
FIG. 6 illustrates the back of the product of FIG. 1 and an intermediate sheet prior to coupling therebetween.

As noted above, in one example embodiment the packaging system 200 may be employed to package a product 300 such as a SMART COVER™ manufactured by Apple Inc. of Cupertino, Calif. FIG. 6 illustrates the back of product 300. The product 300 may include a cover portion 302 and a hinged portion 304. In some embodiments the packaging system 200 may further comprise an intermediate sheet 800 which may be employed to protect the product 300, properly position the product in the packaging system, and/or assist in retrieving the product from the packaging system. FIG. 6 illustrates the intermediate sheet prior to coupling with the product 300. The intermediate sheet 800 may include a major panel 802, an adhesive section 804, and a pull tab 806. A score line 808 may be positioned between the pull tab 806 and the major panel 802 of the intermediate sheet 800. The intermediate sheet 800 may be configured to couple to the product 300 via an adhesive section 804.

Figure 7:
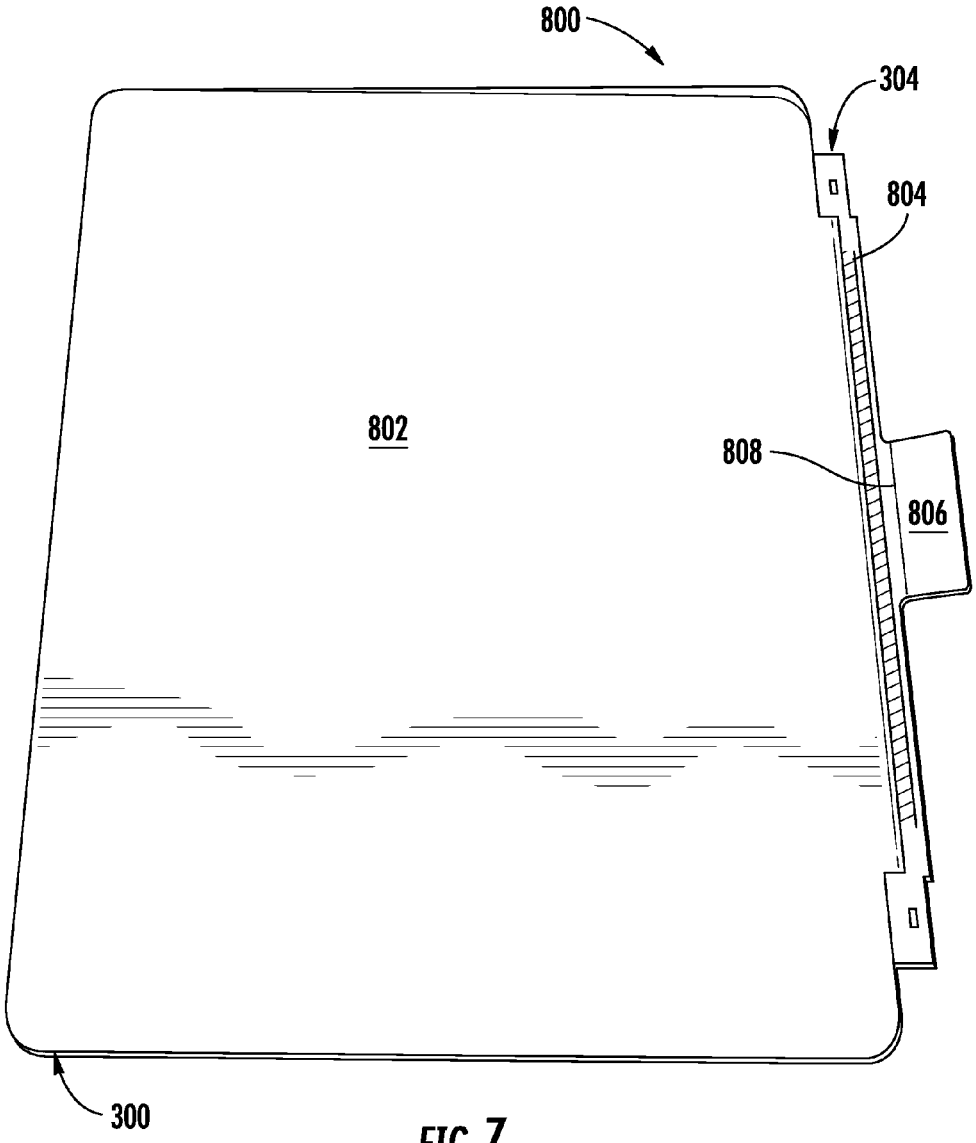
FIG. 7 illustrates the product and the intermediate sheet of FIG. 6 after coupling therebetween.

As illustrated in FIG. 7, the adhesive section 804 of the intermediate sheet 800 may be configured to engage the backside of the hinged portion 304. Thereby, the intermediate sheet 800 may cover substantially the entirety of the backside of the product 300 including the cover portion 302. The pull tab 806 may extend outwardly there from in a substantially planar configuration.

Figure 8:
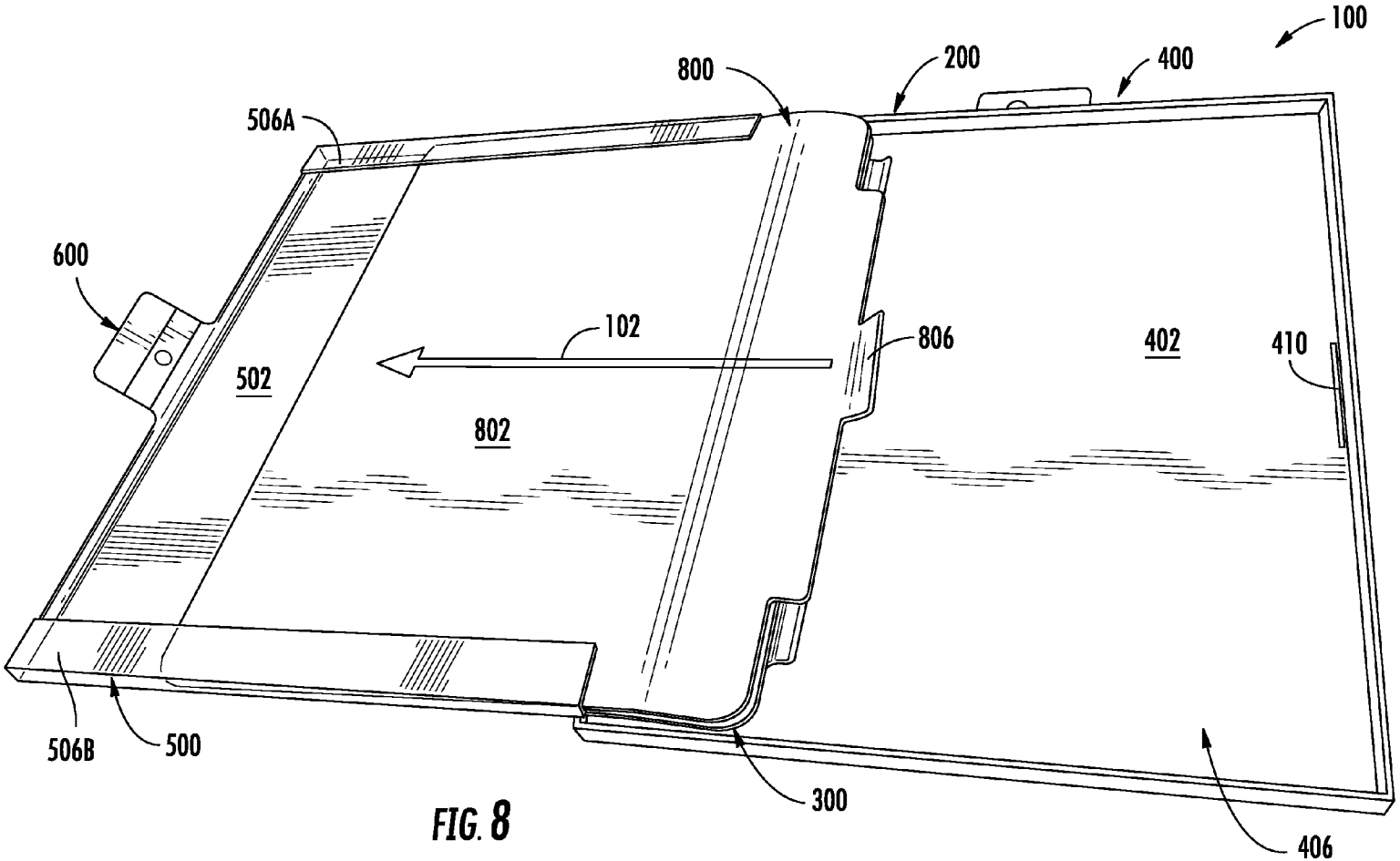
FIG. 8 illustrates a perspective view of the product and the intermediate sheet of FIG. 7 during insertion between end flaps of the lid of FIG. 2.

After the intermediate sheet 800 is coupled to the product 300, the product may be combined with the remainder of the packaging system 200. In this regard, as illustrated in FIG. 8, the product 300 (with the intermediate sheet 800 coupled thereto) may be slid between the first and second end flaps 506 in the direction indicated by the arrow 102. Alternatively, the product 300 may be placed on the major panel 502 of the lid 500 and the first and second end flaps 506 may be folded over the product 300.

Figure 9:
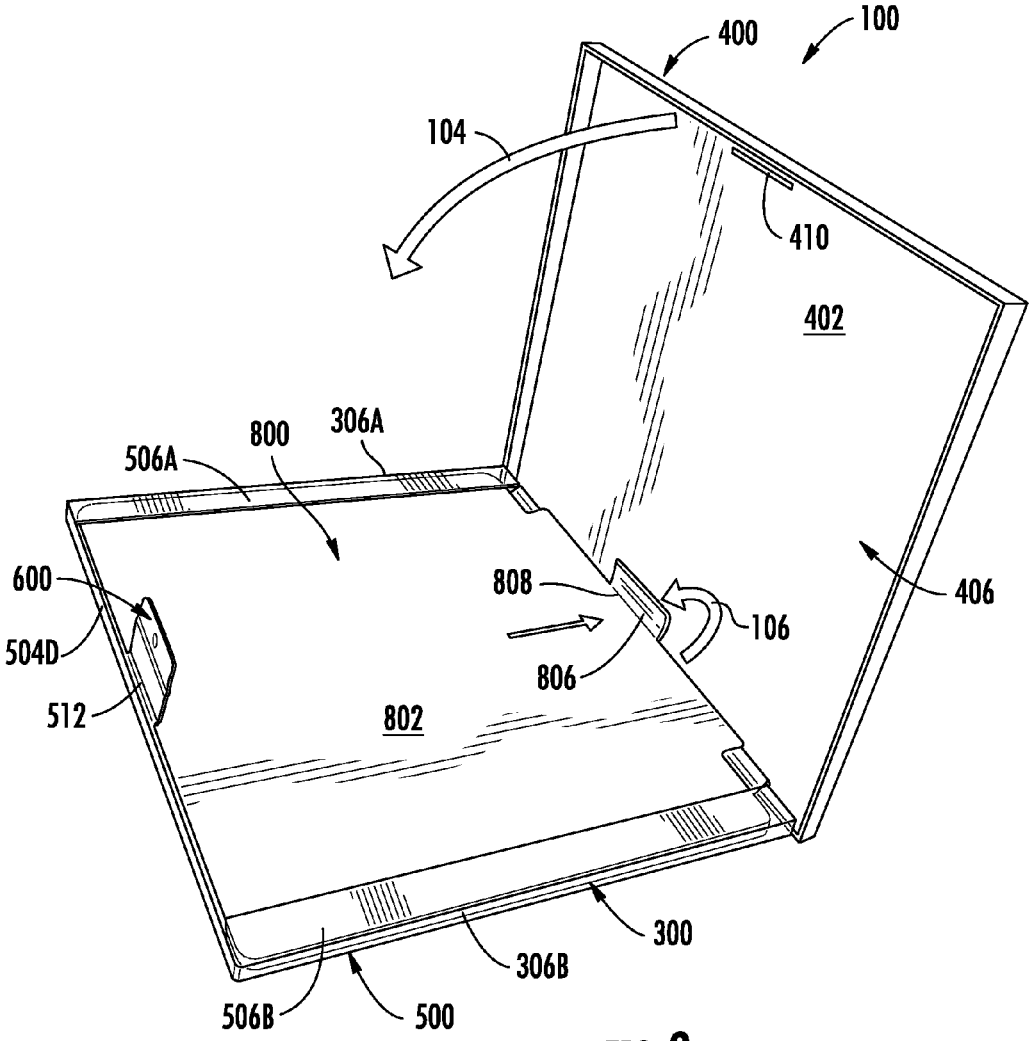
FIG. 9 illustrates a perspective view of the box and the lid of the packaging system of FIG. 1 in a partially closed configuration.

Accordingly, as illustrated in FIG. 9, the end flaps 506 wrap around edges 306A, B (collectively, "306") of the product 300. Thereby, the product 300 is retained between the end flaps 506 and the major panel 502 of the lid 500. Further, the side panel 504D at which the tab 512 is positioned may prevent the product 300 from sliding out of the lid 500.

After the product 300 is secured in place by the end flaps 506, the lid 500 may be pivoted relative to the box 400 to a closed configuration. For example, the lid 500 and the product 300 may be pivoted into the interior compartment 406 of the box 400. Alternatively or additionally, as illustrated by the arrow 104, the box 400 may be pivoted toward the lid 500 and the product 300. For example, the lid 500 and product 300 may remain stationary and the box 400 may be pivoted on top of the lid and product. By retaining the lid 500 and the product 300 in a substantially stationary configuration, the product may remain in place between the end flaps 506 and the major panel 502 of the lid without moving. Accordingly, the product 300, including the hinged portion 304 may remain in the position in which they are placed when the end flaps 506 are wrapped around the product. Thus, the product 300 may remain in a desirable display configuration as the box 400 and lid 500 are pivoted relative to one another to the closed configuration.

As the box 400 and the lid 500 are pivoted relative to one another, the intermediate sheet 800 may be positioned between the product 300 and the bottom wall 402 of the box. Further, the pull tab 806 of the intermediate sheet 800 may be folded, as indicated by arrow 106. When the box 400 and lid 500 reach the closed configuration, the pull tab 806 may reach a position wherein the pull tab lies flat between the major panel 802 of the intermediate sheet and the bottom wall 402 of the box. The score line 808 may assist with folding the pull tab 806 in this manner. Accordingly, the pull tab 806 will automatically fold under the product 300 during pivoting of the lid 500 and box 400 to the closed configuration.

Figure 10:
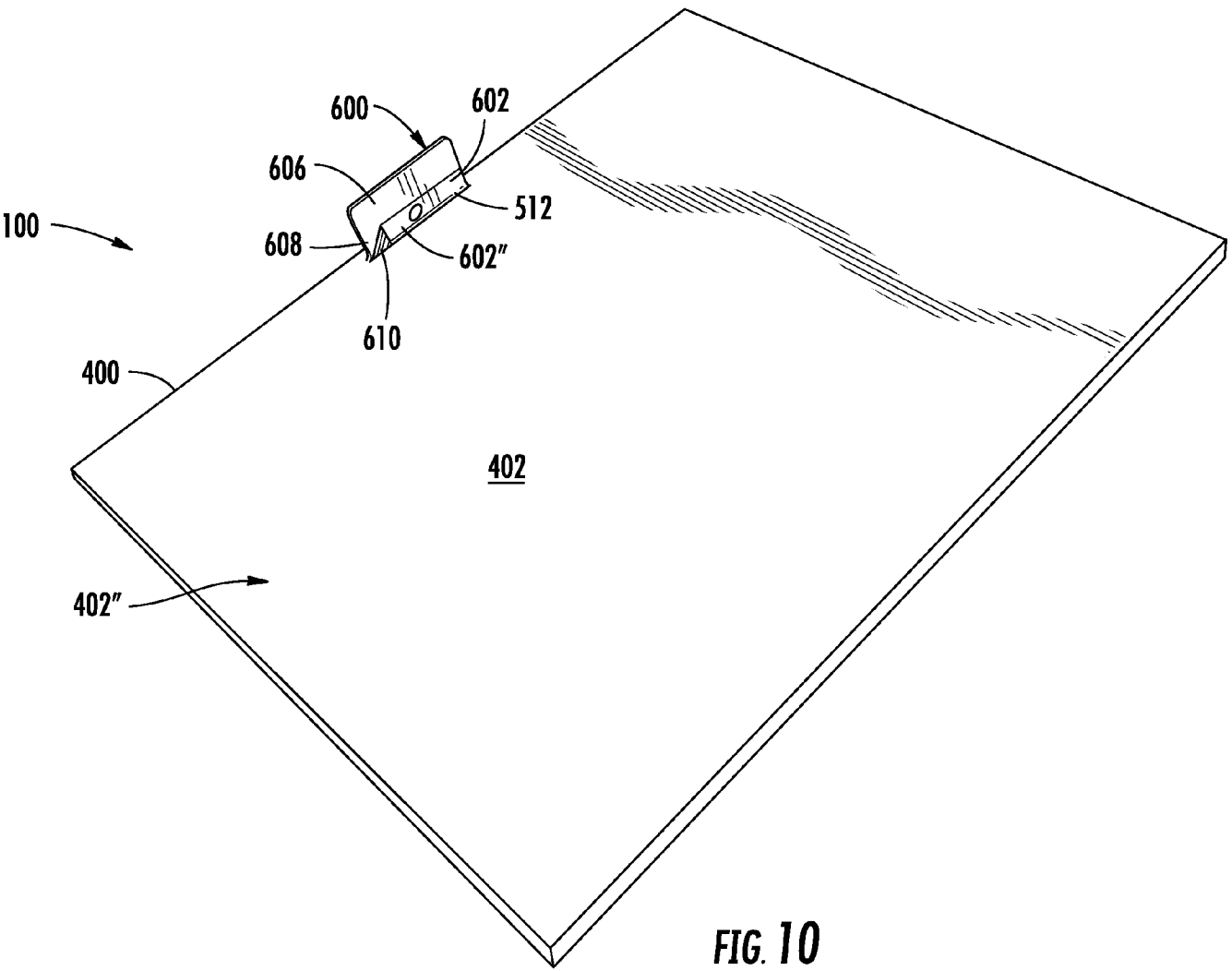
FIG. 10 illustrates a rear perspective view of the packaged product assembly of FIG. 1 prior to coupling the adhesive member to the box.

Further, the tab 512 of the lid 500 and the adhesive member 600 may align with the slot 410 defined in the bottom wall 402 of the box 400 as the lid and the box are pivoted toward one another. Accordingly, as illustrated in FIG. 10, the tab 512 and the adhesive member 600 may extend through the slot 410 defined in the bottom wall 402 of the box 400. This may occur at substantially the same time that the lid 500 is pivoted to the closed configuration and the product 300 is loaded into the inner compartment 406, since the product may be held in place by the lid.

The adhesive member 600 may further comprise an adhesive 608 at an outer surface 602" of the first flap 602. The adhesive member 512 may also include an adhesive liner 610, which is shown as partially removed in FIG. 10, coupled to the adhesive 608. The adhesive liner 610 may prevent the adhesive 608 from adhering to the bottom wall 602 as the adhesive member 600 is inserted through the slot 410.

Figure 11:
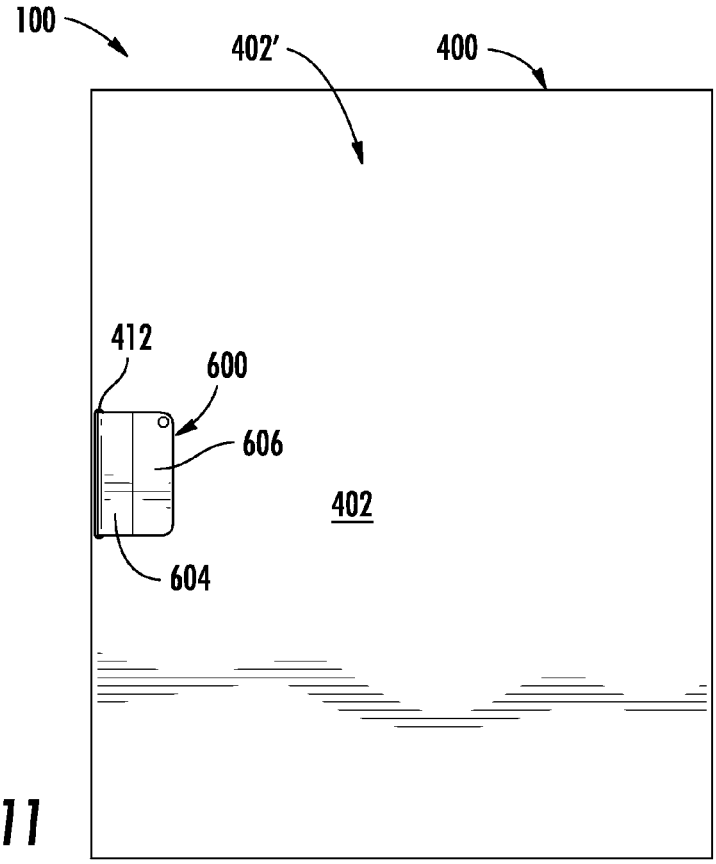
FIG. 11 illustrates an overhead view of the rear of the packaging system of FIG. 1 after the adhesive member is coupled to the box.

After the tab 512 and the adhesive member 600 are inserted through the slot 410 defined in the bottom wall 402 of the box 400, the adhesive liner 610 may be removed such that the adhesive 608 is exposed. The tab 512 may then be bent about score line 514 (see, e.g., FIG. 5). Accordingly, the adhesive 608 of the adhesive member 600 may couple the tab 512 to an outer surface 402" of the bottom wall 402 of the box 400, as illustrated in FIG. 11. Thereby, the lid 500 may be retained in the closed configuration.

In order to access the product 300 from the packaged product assembly 100, a consumer may grasp the extension 606 of the adhesive member 600, which is decoupled from the outer surface 402" of the bottom wall 402 of the box 400 because it does not include an adhesive, in order to detach the adhesive member from the box. Thereafter, a consumer may perform the above-noted operations performed in assembling the packaged product assembly substantially in reverse order. However, various ones of the above-noted steps need not be conducted. For example, after the consumer detaches the adhesive member 600 from the outer surface 402" of the bottom wall 402 of the box 400, he or she can simply push the adhesive member and the tab 512 back through the slot 410 without detaching the adhesive member from the tab.

The consumer may then pivot the lid 500 relative to the box 400 such that the lid reaches the open configuration in which the upper opening 408 to the interior compartment 406 of the box is open. The consumer may then grasp the pull tab 806 of the intermediate sheet 800 and pull opposite the arrow 102 (see, FIG. 8) to remove the product 300 from between the end flaps 506 and the major panel 502 of the lid 500. Alternatively the user may unfold the end flaps 506 to gain access to the product 300. The pull tab 806 may also be used to detach the intermediate sheet 800 from the product 300. Accordingly, a user may gain access to the product 300 from the packaged product assembly 100 in a relatively simple manner. In this regard, scissors or other tools may not be required to retrieve the product 300 from the packaging system 200.

Figure 12:
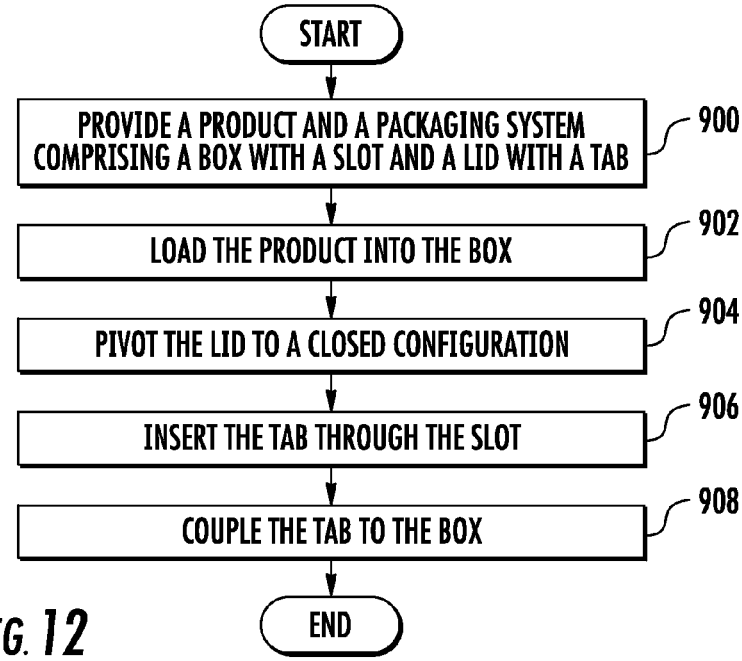
FIG. 12 schematically illustrates a method for packaging a product according to an example embodiment of the present disclosure.

A related method for packaging a product is also provided. As illustrated in FIG. 12, the method may include providing a product and a packaging system at operation 900. The product may comprise an embodiment of the above-described product 300, such as a SMART COVER™. However, various other products may be packaged in accordance with the method.

The packaging system may comprise an embodiment of the above-described packaging system 200 in some embodiments. In this regard, the packaging system may comprise a box comprising a plurality of sidewalls and a bottom wall with a slot defined therein, the sidewalls and bottom wall collectively defining an interior compartment with an upper opening. The packaging system may further comprise a lid comprising a major panel and a tab, wherein the lid is hingedly coupled to one of the sidewalls of the box. The packaging system may also include an adhesive member.

The method may further comprise attaching an intermediate sheet to the product. Attaching the intermediate sheet to the product may comprise adhering the intermediate sheet to a hinged portion of the product. Thereafter, in some embodiments, first and second end flaps of the lid may be wrapped around the product such that the product is retained in place by the lid.

The method may also include coupling a first flap and a second flap of the adhesive member to first and second opposing surfaces of the tab. Thereafter, the method may additionally include loading the product through the upper opening into the interior compartment of the box at operation 902 and pivoting the lid relative to the box to a closed configuration in which the upper opening is closed by the lid at operation 904. As the lid is pivoted at operation 904, a pull tab of the intermediate sheet may be folded. The method may also include inserting the tab of the lid through the slot in the bottom wall of the box at operation 906.

As described above, in some embodiments loading the product into the box at operation 902, pivoting the lid at operation 904, and/or inserting the tab through the slot in the bottom wall at operation 906 may be conducted substantially simultaneously. In this regard, as noted above, the product may be retained by end flaps of the lid such that when the lid and box are pivoted toward one another, the product is inserted is loaded into the box. Further, since the tab forms part of the lid, as the lid and the box are brought toward one another, the tab and the adhesive member coupled thereto may be inserted through the slot in the bottom wall of the box.

After the tab is inserted through the slot at operation 908, the method may further include adhesively coupling the tab to an outer surface of the bottom wall of the box with the adhesive member to retain the lid in the closed configuration at operation 908. For example, an adhesive liner may be removed from adhesive on the adhesive member, which may then be folded into contact with the outer surface of the bottom wall of the box. Accordingly, the box and the lid may be coupled together via the adhesive member such that the product may be retained by the packaging system.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A packaging system, comprising:

a box comprising a plurality of sidewalk and a bottom wall with a slot defined therein, the sidewalls and bottom wall collectively defining an interior compartment with an upper opening configured to receive a product;

a lid comprising a major panel and a tab, wherein the lid is hingedly coupled to one of the sidewalls of the box and movable between an open configuration in which the upper opening is open and a closed configuration in which the lid covers the upper opening and the tab is received through the slot in the bottom wall; and an adhesive member coupled to the tab and configured to releasably engage an outer surface of the bottom wall and thereby retain the lid in the closed configuration.

2. The packaging system of claim 1, wherein the adhesive member comprises a first flap and a second flap coupled to first and second opposing surfaces of the tab and an extension that extends past an end of the tab.

3. The packaging system of claim 2, wherein an inner surface of the first flap and an inner surface of the second flap comprise an adhesive.

4. The packaging system of claim 2, wherein an outer surface of the first flap comprises an adhesive.

5. The package system of claim 2, wherein the extension is configured to be decoupled from the outer surface of the bottom wall.

6. The packaging system of claim 1, wherein the lid comprises a plurality of side panels.

7. The packaging system of claim 6, wherein one of the side panels of the lid is coupled to one of the sidewalk of the box, and wherein the tab extends from one of the side panels that is opposite to the one of the side panels coupled to one of the sidewalls.

8. The packaging system of claim 7, wherein the lid further comprises first and second end flaps extending from the side panels between the tab and the one of the side panels coupled to one of the sidewalls.

9. A packaged product assembly, comprising:

a packaging system, comprising:

a box comprising a plurality of sidewalls and a bottom wall with a slot defined therein, the sidewalls and bottom wall collectively defining an interior compartment with an upper opening;

a lid comprising a major panel and a tab, wherein the lid is hingedly coupled to one of the sidewalls of the box and configured in a closed configuration in which the lid covers the upper opening and the tab is received through the slot in the bottom wall; and an adhesive member coupled to the tab and releasably engaged to an outer surface of the bottom wall such that the lid is retained in the closed configuration; and a product positioned in the interior compartment.

10. The packaged product assembly of claim 9, wherein the lid comprises a. plurality of side panels that extend about a plurality of edges of the product.

11. The packaged product assembly of claim 10, wherein one of the side panels of the lid is coupled to one of the sidewalls of the box, and wherein the tab extends from one of the side panels that is opposite to the one of the side panels coupled to one of the sidewalls.

12. The packaged product assembly of claim 10, wherein the lid further comprises first and second end flaps extending from the side panels between the tab and the one of the side panels coupled to one of the sidewalls, and wherein the end flaps wrap around two of the edges of the product.

13. The packaged product assembly of claim further comprising an intermediate sheet positioned between the product and the bottom wall of the box.

14. The packaged product assembly of claim 13, wherein the product comprises a hinged portion and the intermediate sheet is adhesively coupled to the hinged portion.

15. The packaged product assembly of claim 14, wherein the intermediate sheet comprises a pull tab that is folded under the product.

* * * * *

UNITED STATES PATENT AND TRADEMARK OFFICE

CERTIFICATE OF CORRECTION

PATENT NO. : 8,544,680 B2
APPLICATION NO. : 13/416855
DATED : October 1, 2013
INVENTOR(S) : Akana et al.

It is certified that error appears in the above-identified patent and that said Letters Patent is hereby corrected as shown below:

In the Claims

In column 7, line 17 (claim 1): "of sidewalk and" should be --of sidewalls and--.

In column 7, line 45 (claim 7): "the sidewalk of" should be --the sidewalls of--.

In column 8, line 23 (claim 10): "comprises a. plurality" should be --comprises a plurality--.

Signed and Sealed this
Third Day of December, 2013

Margaret A. Focarino

Margaret A. Focarino
*Commissioner for Patents of the United States Patent and Trademark Office*